United States Patent [19]

Rutchik

[11] Patent Number: 4,928,413

[45] Date of Patent: May 29, 1990

[54] DISPLAY DEVICE

[75] Inventor: Robert K. Rutchik, Lyons, Ill.

[73] Assignee: Rapid Mounting & Finishing Company, Chicago, Ill.

[21] Appl. No.: 204,248

[22] Filed: Jun. 9, 1988

[51] Int. Cl.[5] ..... G09F 11/30

[52] U.S. Cl. ..... 40/511; 40/508

[58] Field of Search ..... 40/511, 476, 419, 417, 40/511, 508, 509

[56] References Cited

U.S. PATENT DOCUMENTS

| | | | |
|---|---|---|---|
| 1,187,113 | 6/1916 | Truetzschler | 40/419 |
| 1,230,313 | 6/1917 | Meese | 40/511 |
| 1,353,105 | 9/1920 | Wheeler | 40/511 |
| 1,389,592 | 9/1921 | Mather | 40/511 |
| 1,446,731 | 2/1923 | Williamson | 40/511 |

FOREIGN PATENT DOCUMENTS

| | | | |
|---|---|---|---|
| 49816 | 6/1909 | Switzerland | 40/511 |

*Primary Examiner*—James R. Brittain
*Assistant Examiner*—J. Hakomaki
*Attorney, Agent, or Firm*—Wood, Phillips, Mason, Recktenwald & Vansanten

[57] ABSTRACT

A display device having a cabinet for mounting first and second display panels, each having a display surface for a message. The panels are mounted in mutually overlying relationship so that one of the display surfaces can be viewed through an opening in the front of the cabinet. Structure is provided for interchanging the first and second panels so that the other of the first and second display surfaces is exposed to be viewed through the front cabinet opening.

11 Claims, 9 Drawing Sheets

FIG. 1
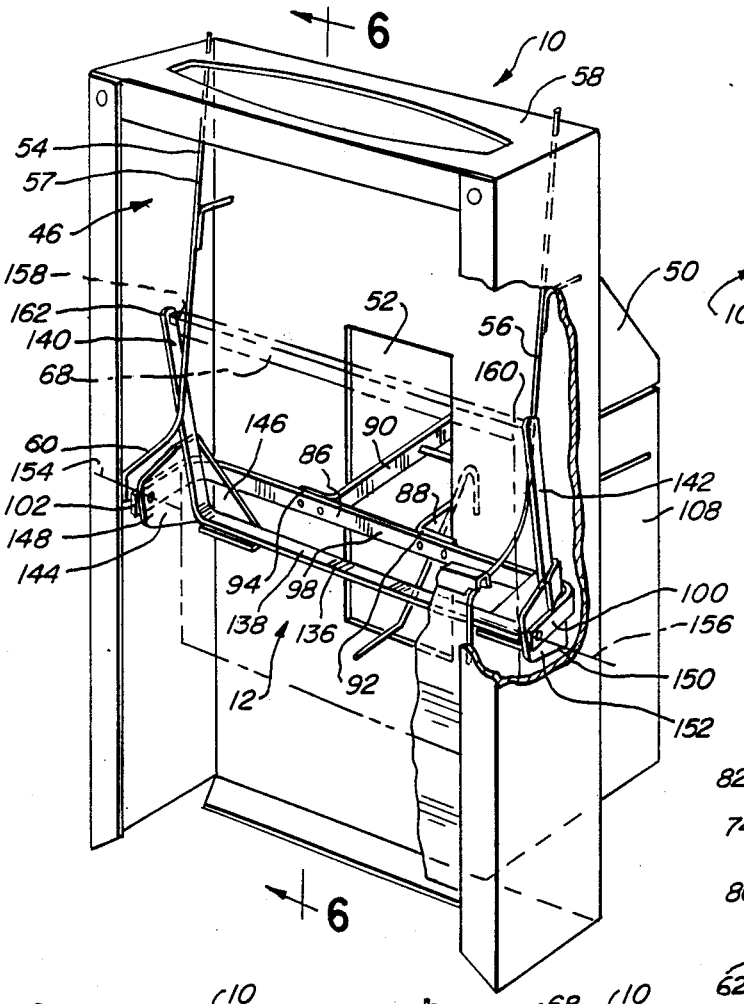
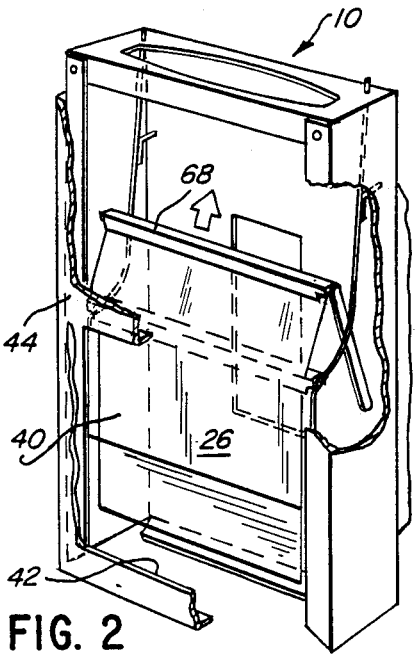
FIG. 2
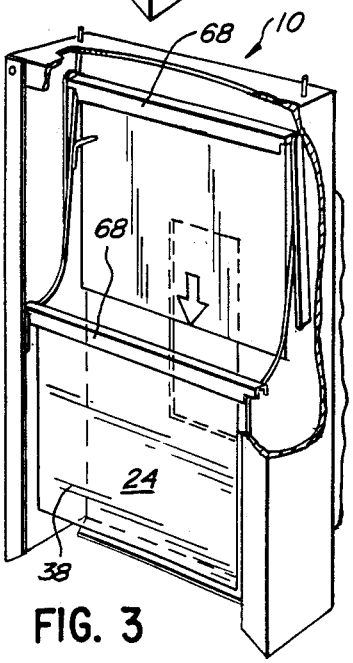
FIG. 3
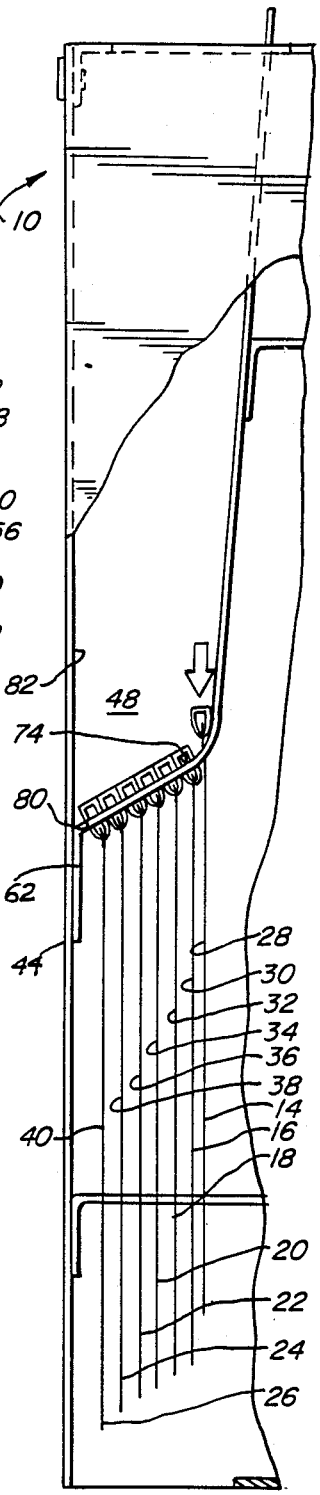
FIG. 4

FIG. 6
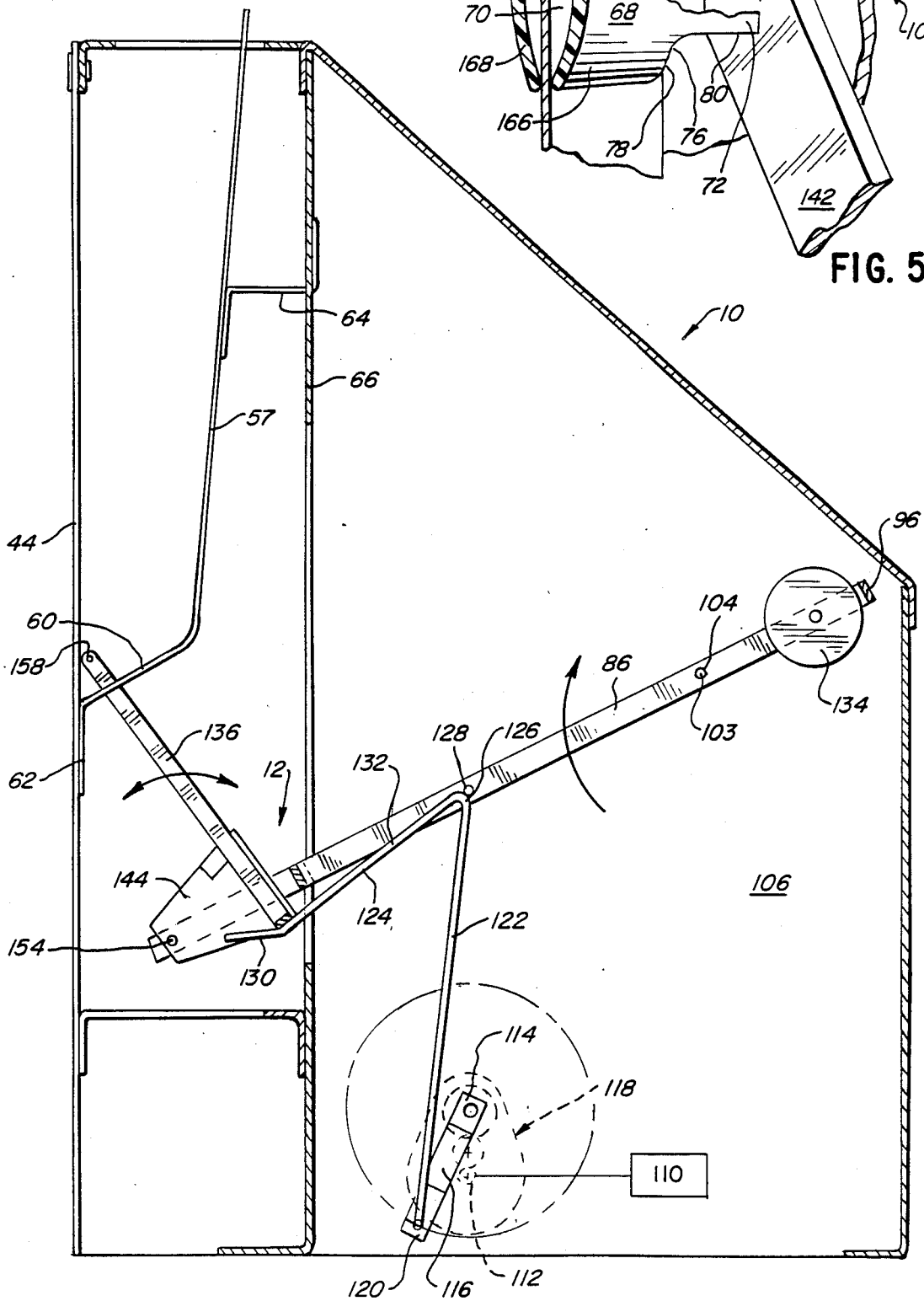
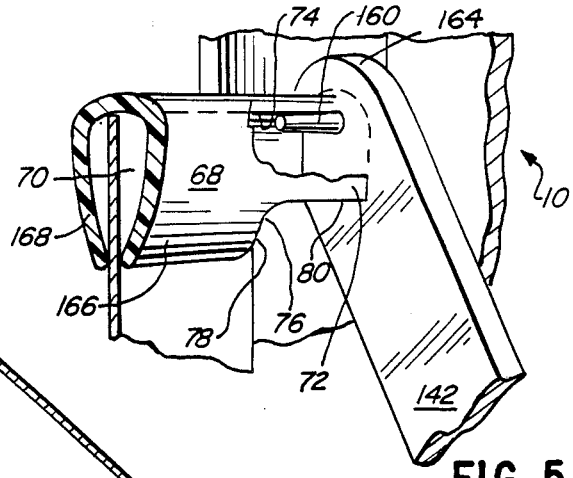
FIG. 5

FIG. 12
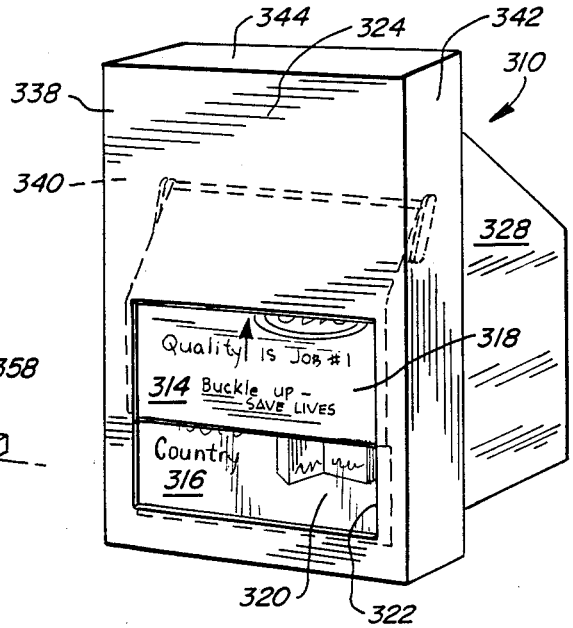
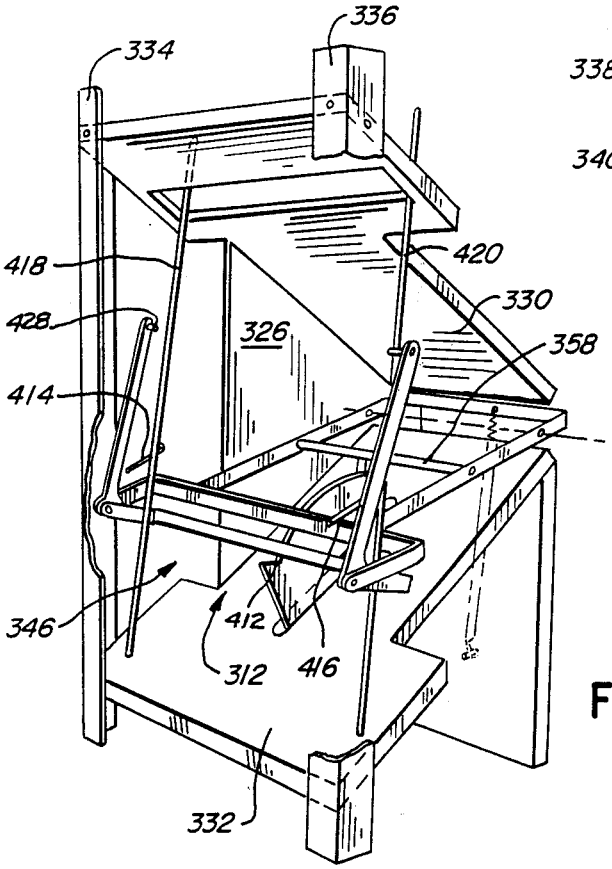
FIG. 13
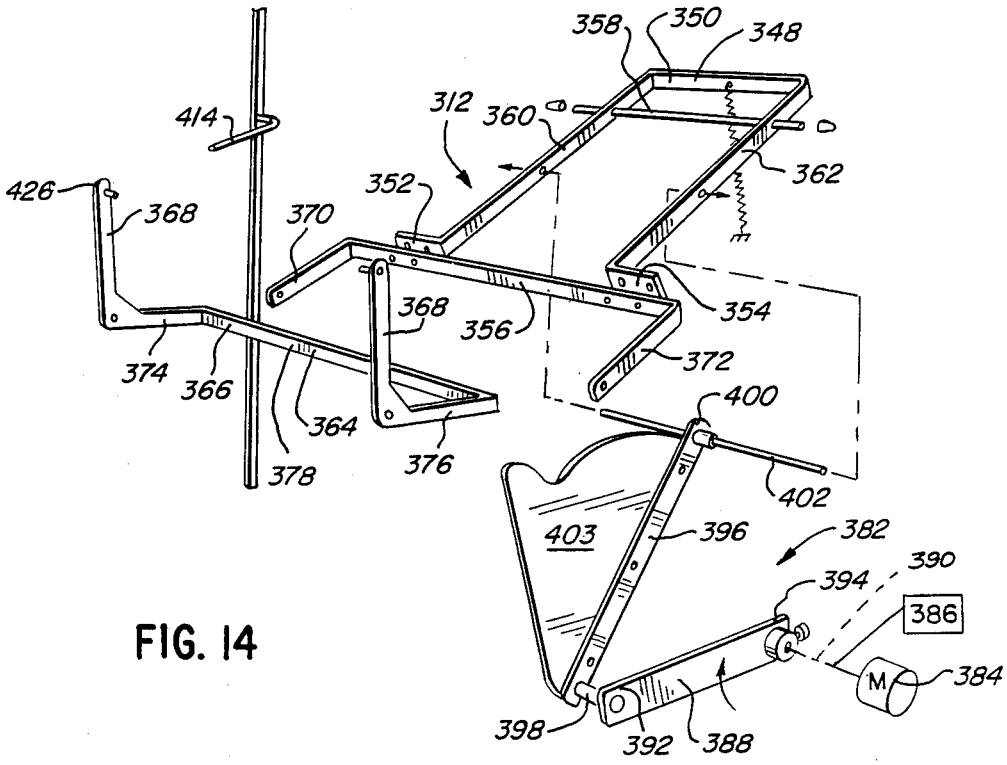
FIG. 14

DISPLAY DEVICE

BACKGROUND OF THE INVENTION

1. Field of the Invention

This invention relates to display devices and, more particularly, to a device for interchanging a plurality of panels to continuously vary a displayed message.

2. Background Art

Designers of display devices strive to develop simple devices, yet ones which have the versatility to display numerous different messages. Often, these two objectives are competing.

It is known to provide overlying and intermeshing panels which produce different messages, depending upon the relative relationship of the panels. Such devices are inherently complicated and limited as to the number of different messages that can be produced. Further, the messages must be precisely placed and coordinated on the panels so that the resulting message is clear and aesthetically desirable.

Additionally, the prior art devices have been, by reason of their complicated nature, quite expensive to manufacture and prone to failure.

SUMMARY OF THE INVENTION

The present invention is specifically directed to overcoming the above-enumerated problems in a novel and simple manner.

A display device according to the invention has a cabinet for mounting first and second display panels, each having a display surface for a message. The panels are mounted in mutually overlying relationship so that one of the display surfaces can be viewed through an opening in the front of the cabinet. Structure is provided for interchanging the first and second panels so that the other of the first and second display surfaces is exposed to be viewed through the front opening.

Each panel, which is preferably made from light cardboard, can carry its own complete message on its display surface. While in its simplest state, the device has two interchangeable panels, the device is virtually unlimited as to the number of panels that can be accommodated.

With the inventive structure, the display panels are arranged compactly in face-to-face alignment and are carried so that they are urged under their own weight towards the front wall of the cabinet in close proximity to the viewing opening. The interchanging/repositioning structure engages the forwardmost panel, lifts it up over and deposits it behind the stack of panels, which shifts forwardly in the cabinet so that the now forwardmost panel is moved into display position to thereafter be picked up and deposited behind the stack by the interchanging structure.

To effect repositioning of the panels, a reciprocating pivot arm is provided and has an associated yoke with pickup pins for engaging the panels. The yoke is pivotally attached to the arm for movement about a horizontal axis. Under its own weight, the yoke tends to pivot on the arm so that pickup pins, which engage the panels, are biased rearwardly of the cabinet. Upon the arm being pivoted upwardly from its lowermost point of travel, a deflector tips the yoke so that the pins move forwardly into engaging position with the forwardmost panel. Further upward pivoting of the arm draws the pins, which carry a panel, upwardly and, at a predetermined position of the arm, the deflector releases the yoke which thereby pivots under its own weight to shift the pins with the attached panel rearwardly so that the panel is moved behind the stack of one or more panels. On the return, downward movement of the arm, the yoke encounters the deflector which pivots the yoke so that the pin releases the then engaged panel, which falls into place in the stack and moves the pin for engagement with the then forwardmost panel.

A rotary drive, through a crank arm, engages the deflector, which in turn is pivotally attached to the arm. Rotation of a drive shaft on the drive motor imparts the reciprocative pivoting movement of the arm.

BRIEF DESCRIPTION OF THE DRAWINGS

FIG. 1 is a perspective view of a display device according to the present invention having a cabinet with a front panel thereon defining an opening for selective viewing of a plurality of display panels and a mechanism for individually repositioning the display panels;

FIG. 2 is a perspective view of the display device with the repositioning mechanism initiating removal of a panel exposed at the viewing opening;

FIG. 3 is a perspective view of the display device with the removed display panel repositioned for disposition behind a stored supply of display panels;

FIG. 4 is an enlarged, side elevation view of the display device showing a plurality of the display panels in stored position;

FIG. 5 is an enlarged, fragmentary perspective view of pickup structure on the repositioning mechanism engaged with a display panel;

FIG. 6 is a sectional view of the display device taken along line 6—6 of FIG. 1 with the repositioning mechanism in position for pickup of a panel in display position at the front viewing opening;

FIG. 12 is a perspective view of a modified form of display device according to the present invention and having a cabinet and panel repositioning mechanism;

FIG. 13 is a perspective view of the display device in FIG. 12 with a front covering on the cabinet removed;

FIG. 14 is an exploded, perspective view of the panel repositioning mechanism on the device in FIGS. 12 and 13;

DESCRIPTION OF THE PREFERRED EMBODIMENTS

Figure 7:
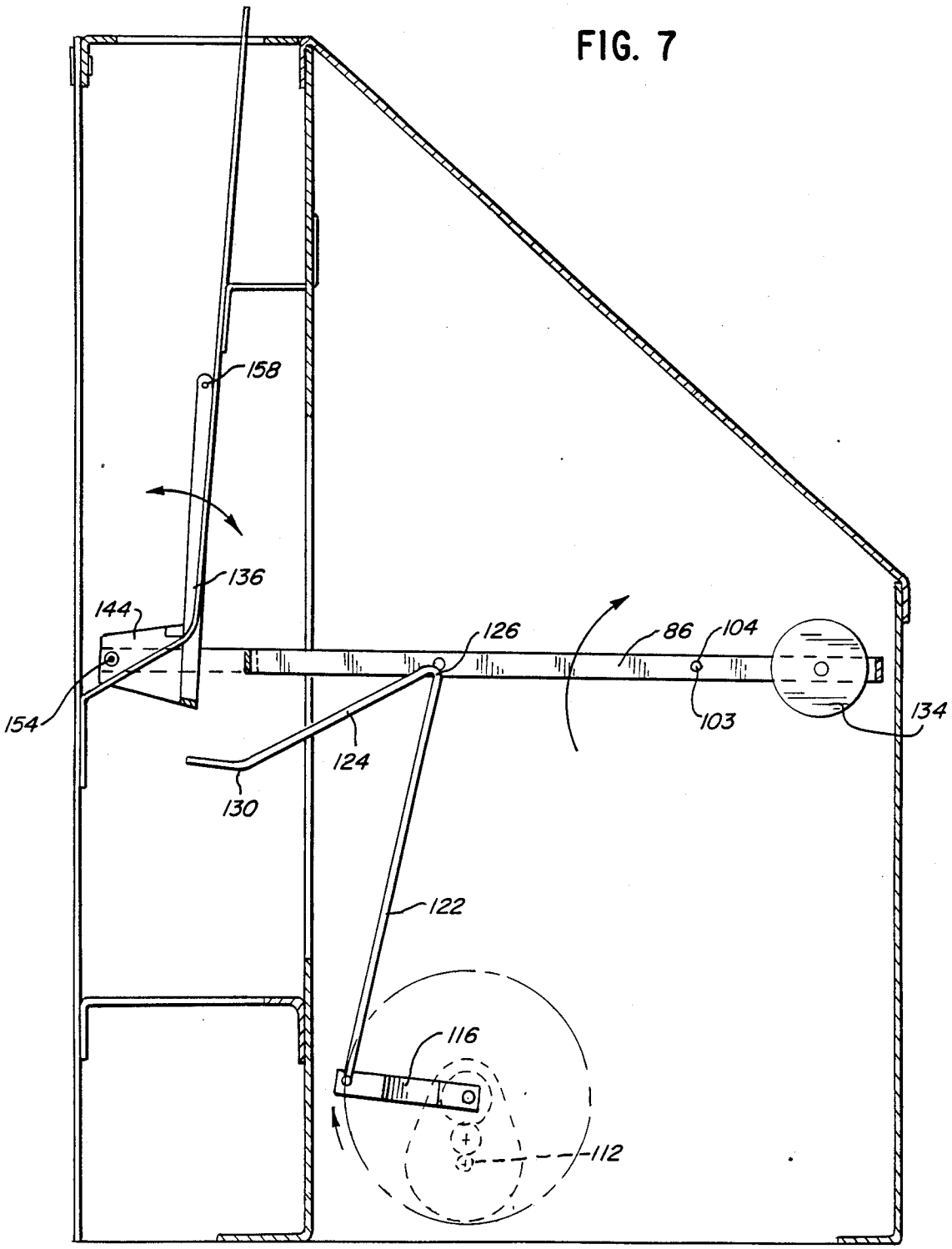
FIG. 7 is a view as in FIG. 6 with the repositioning mechanism moving the picked up panel upwardly out of its display position.
Figure 8:
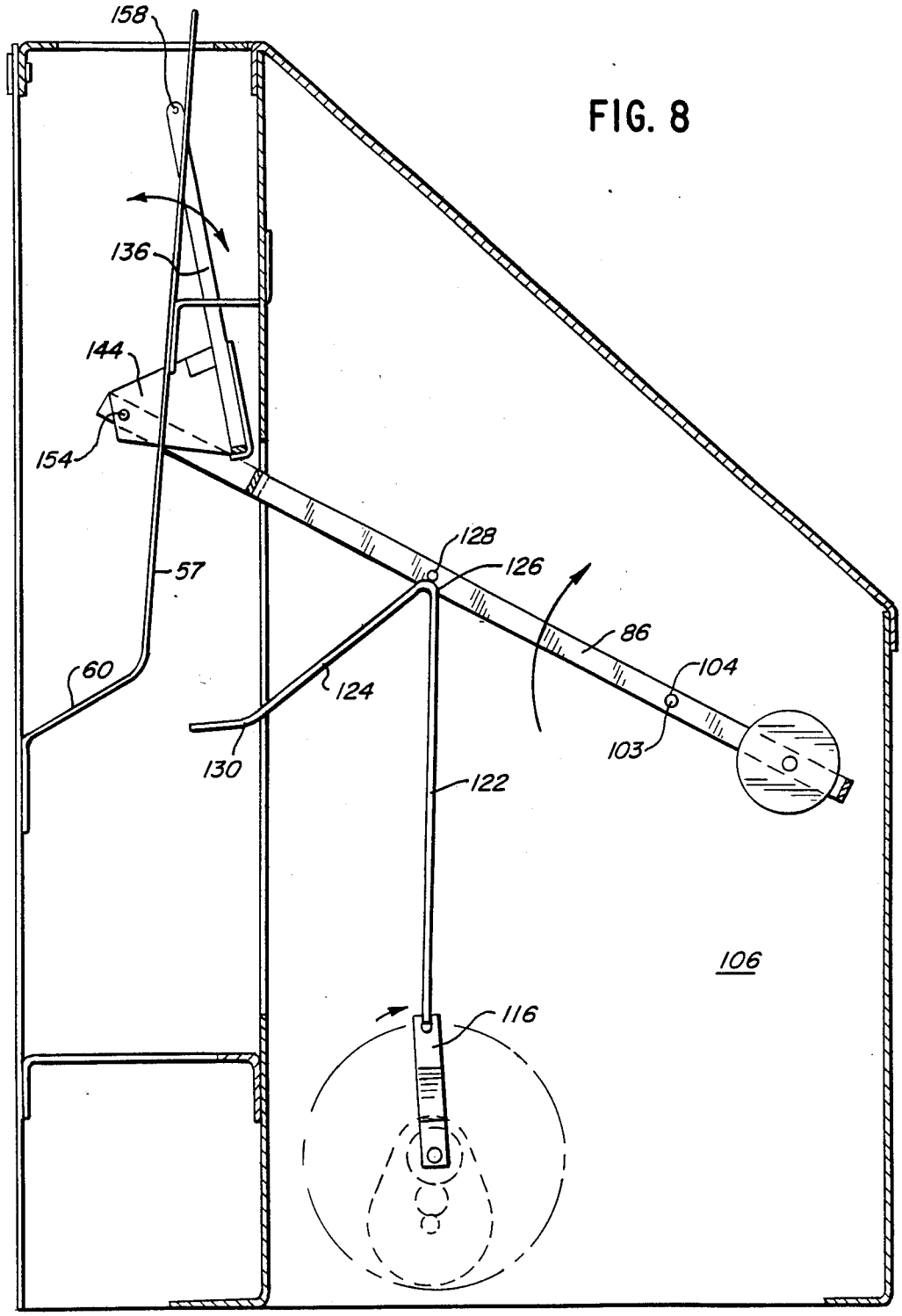
FIG. 8 is a view as in FIG. 6 with the mechanism positioned for dropping the picked up display panel behind a stored supply of panels.
Figure 9:
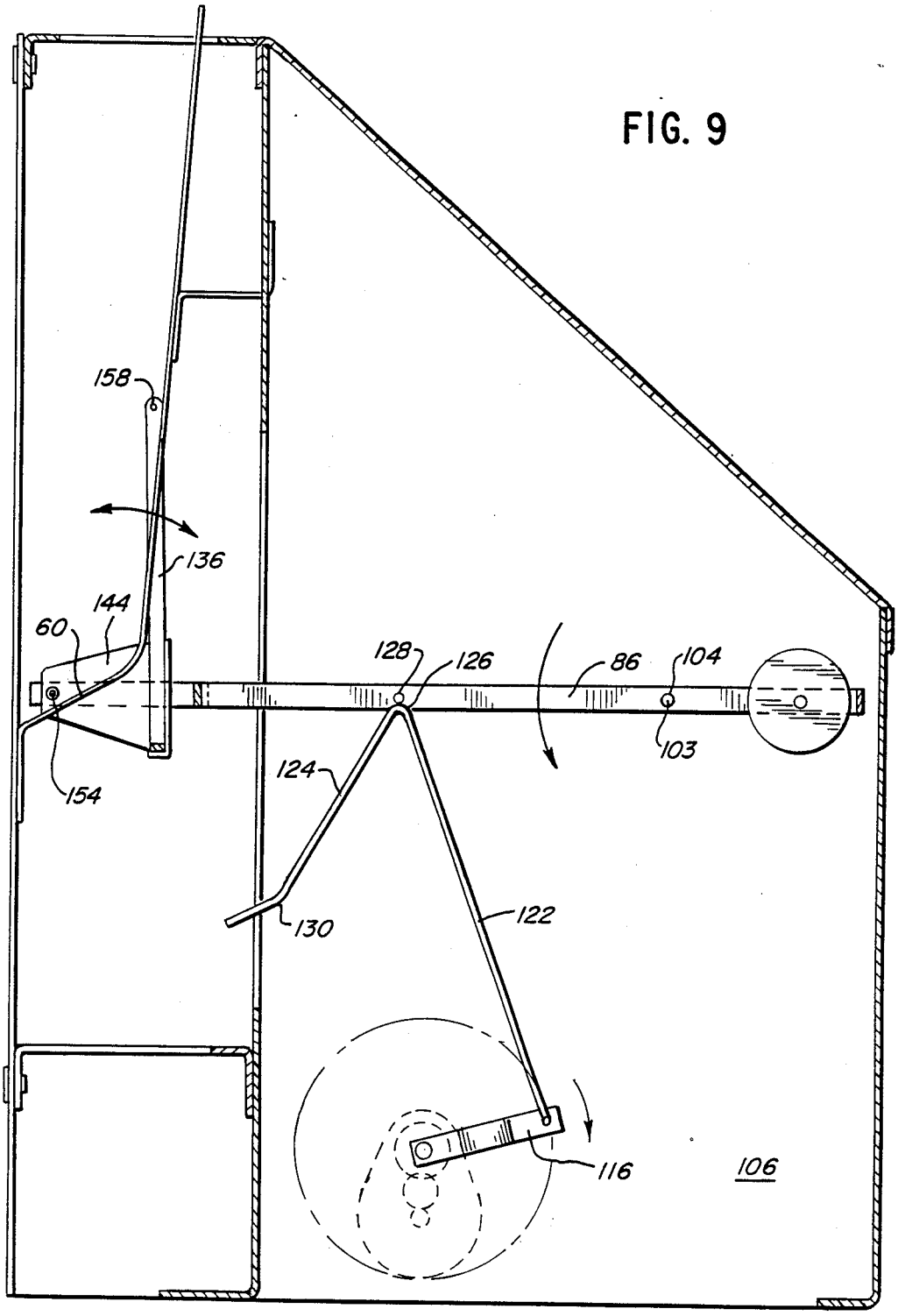
FIG. 9 is a view as in FIG. 6 with the mechanism lowering the removed panel behind the stored supply of panels.
Figure 10:
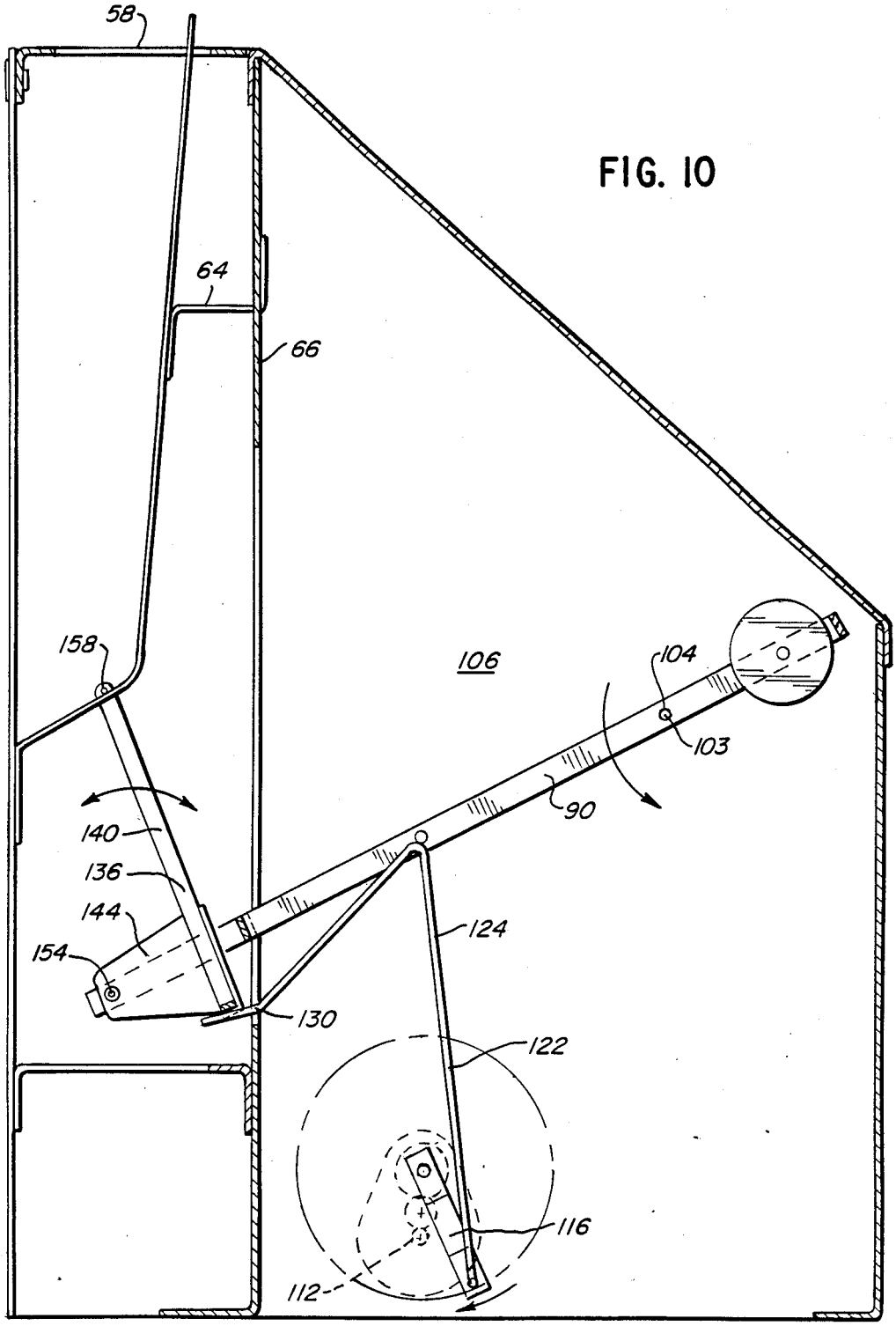
FIG. 10 is a view as in FIG. 6 with the mechanism depositing the removed panel on a rail behind the stored supply of panels.

Referring initially to FIGS. 1–6, a preferred form of the display device is shown and consists of a cabinet at 10, and a mechanism 12 for interchanging/repositioning a plurality of panels 14, 16, 18, 20, 22, 24, 26 shown in a stored position in FIG. 4. Each panel 14, 16, 18, 20, 22, 24, 26 has a display surface 28, 30, 32, 34, 36, 38, 40 consecutively, with a message thereon to be viewed through an opening 42 in the front wall 44 of the cabinet 10. The mechanism 12 repositions the stored panels 14–26 so that selected messages on the display surfaces 28–40 are visible through the viewing opening 42.

The cabinet has a rectangular front section 46 defining a space 48 within which the panels 14–26 are stored and therebehind a housing 50 defining a chamber 52 in communication with the space 40 and within which a portion of the mechanism 12 moves. The formation of the cabinet 10 to the depicted configuration can be readily accomplished using conventional techniques. Preferably, the entire cabinet is made from cardboard, or other like material, to minimize its weight.

Within the front section 46 are two laterally spaced guide/support rails 54, 56. The rails 54, 56 are spaced apart a distance slightly greater than the lateral dimension of the panels and each rail 54, 56 has a generally L-shaped configuration with the vertical leg 57 thereon extending through the top wall 58 of the cabinet 10. The leg 57 is directed slightly forwardly from top to bottom, as seen clearly in FIG. 6. The horizontal leg 60 declines slightly towards the front wall 44 of the cabinet and has an offset 62 which is secured to the front wall 44. A Z-shaped brace 64 is connected to a wall 66 between the front section 46 and housing 50 and reinforces the mid-portion of the leg 57.

Each panel 14–26 is preferably formed from a thin sheet of material, such as cardboard, and has a rectangular shape. A channel 68 surrounds and captures the top edge 70 of each panel 14–26, as shown clearly in FIG. 5. The channel 68 is substantially U-shaped in cross section and at each lateral edge has an extension 72 with an inverted U-shaped configuration and a downwardly facing surface 74 at the base of the U. The extensions 72 each have a cut-out 76 defining inclined surfaces 78 on the channel 68 which blend into downwardly facing guide edges 80. The surfaces 78 guide the channels 68 on the guide/support rails 54, 56 so that the associated panels 24–26 are centered therebetween. The edges 80 support the channels 68 and associated panels 14–26 on the guide/support rails 54, 56, as shown in FIG. 4. In the storage position of FIG. 4, the supply of panels 14–26 hang from the channels 68 on the horizontal legs 60 of the guide/support rails 54, 56 and under their own weight tend to slide down the guide/support rails 54, 56 and against the inside surface 82 of the front wall 44.

According to the invention, the mechanism 12 engages the channel 68 on the forwardmost panel, which in FIG. 4 is the panel 26, raises the panel 26 upwardly above the remainder of the panels 14–24, moves the panel 26 rearwardly and deposits the same behind the rearwardmost panel in the stored stack, i.e. panel 14 in FIG. 4. Once the panel 26 is removed, the remainder of the panels 14–24 shift forwardly on the guide/support rails 54, 56, thereby creating a space for the deposition of the removed panel 26. The display surfaces 28–40 each can carry a different message and through the mechanism 12, the display surfaces 28–40 are successively presented to the front wall for viewing through the opening 42.

The mechanism 12 for accomplishing the interchange/repositioning of the panels 14–26 consists of a T-shaped arm 86. The stem of the T is defined by two parallel members 88, 90, each connected at its front end 92, 94 to the cross bar 98 and to each other at their rear end 96 so that they cooperatively enclose a rectangular space. The cross bar 98 of the arm 86 has forwardly projecting offsets 100, 102 which are substantially parallel and laterally spaced from each other a distance greater than the lateral dimension of the panels 14–26.

The arm 86 is supported for pivoting movement about a horizontal axis 103 on shaft 104, which is supported by laterally spaced walls 106, 108 on the housing 50. Reciprocating pivoting movement of the arm 86 is imparted through a drive motor 110. The motor 110 has a rotary shaft 112 that drives one end 114 of a crank arm 116 through a speed reduction mechanism 118. The opposite end 120 of the crank 116 is pivotally connected to one leg 122 of a V-shaped deflector 124. The apex 126 of the V-shaped deflector 124 is connected to a rod 128 which extends through and is pivotally connected to both members 88, 90 on the arm 86.

The resulting movement of the arm 86 for each rotation of the motor shaft 112 is shown sequentially in FIGS. 6–11. In the FIG. 6 position, the arm 86 and deflector 124 are pivoted to their downwardmost position. After one half revolution for the motor shaft 112, the FIG. 8 position is realized and arm 86 and deflector 124 are in their uppermost position. For each rotation of the shaft 112, reciprocating, pivotal movement for the arm 86 through a predetermined range is imparted through the deflector 124. Through one complete rotation an offset 130 at the free end of leg 132 on the deflector is caused to reciprocate in a generally vertical path from the FIG. 6 position to the FIG. 8 position and back again as the rotation is completed. A weight 134 is carried adjacent the rear end 96 of the members 88, 90 to counterbalance the torque exerted on the arm by a yoke 136 at the front end of the arm, which yoke 136 carries the individual panels 14–26 during the interchange/reposition process.

The yoke 136 is U-shaped and has a base 138 and legs 140, 142 spaced laterally from each other by a distance slightly greater than the lateral dimension of the panels 14, 26. A mounting pad 144 is secured to the yoke 136 and has a wall 146 that overlies the base 138 and leg 140 at the juncture thereof and an integral wall 148 at right angles to the wall 146 and extending around the outside of leg 140. Pad 150 is similarly configured and attaches to the yoke 136 at the opposite side and has a wall 152 corresponding to the wall 148 extending around the leg 142 on the yoke 136. Each wall 148, 152 is pivotally attached to its adjacent offset 100, 102 on the cross bar 98 of the arm 86 for pivoting movement about aligned, horizontal axes 154, 156. As seen clearly in FIGS. 1 and 6, the weight of the yoke 136 produces a torque tending to rotate the yoke in a counterclockwise direction about the axes 154, 156.

Figure 11:
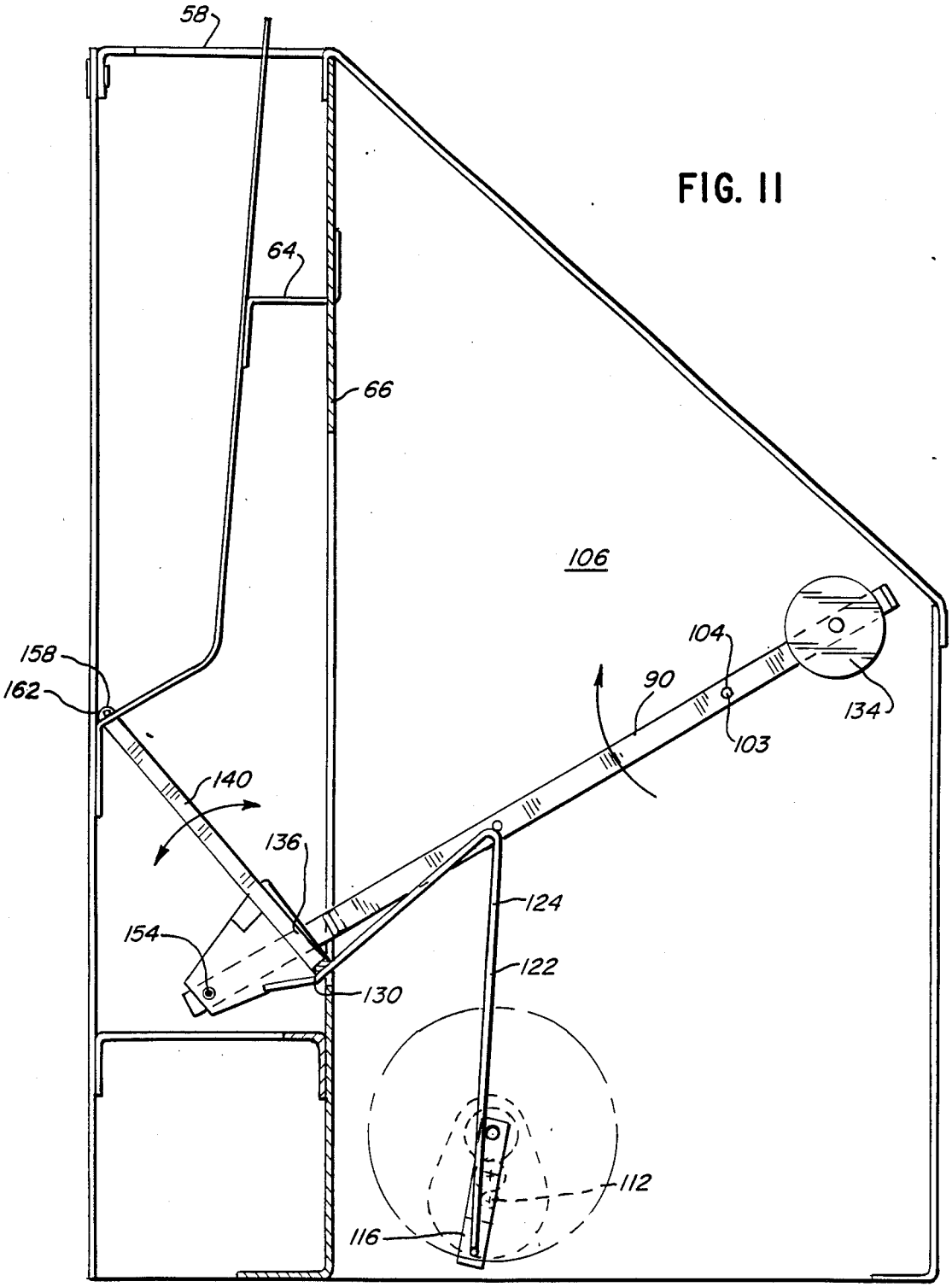
FIG. 11 is a view as in FIG. 6 with the mechanism in a pickup position for the forwardmost panel in its display position adjacent the viewing opening.

The yoke 136 has lifting pins 158, 160 on legs 140, 142 respectively, which extend under the extensions 72 on the channel 68, bear on the underside 74 of the channels 68 and cooperatively support each individual panel during the interchange/reposition process. The pickup position for the mechanism 12 for a panel 14–26 in the forwardmost position is shown in FIG. 11. In the transition from the FIG. 8 position, rotation of the drive shaft 112 pivots the arm 86 downwardly, causing the offset 130 on the deflector 124 to bear against the yoke 136 and thereby impart a counterclockwise rotation thereto and as an incident thereof tip the pins 158, 160 forwardly. As this occurs, the rounded edges 162, 164 at the leading edge of legs 140, 142 on the yoke 136 abut the rearwardly facing surface 82 on the front wall 44. This aligns the lifting pins 158, 160 between the channel legs 166, 168 on the extensions 72 of the channel 68. Upon the legs 140, 142 first encountering the front wall 44 of the cabinet 10, the pins 158, 160 are slightly below the horizontal legs 60 of the guide/support rails 54, 56 and the guide edges 80 on the channel 68. Further rotation of the shaft 112 drives the pins 158, 160 against the surface 74 on the channel 68, whereupon continued rotation of the drive motor 110 from the FIG. 11 position pivots the arm 86 and yoke 136 upwardly as shown in FIG. 6 so that the pins 158, 160 on the yoke 136 draw the forwardmost panel, panel 26 in FIG. 4, upwardly off the guide/support rail legs 60.

In the FIG. 7 position for the mechanism 12, the yoke 136 moves upwardly away from the offset 130 on the deflector 124 and, as this occurs, the yoke 136 pivots clockwise in FIG. 7 under its own weight and the weight of the attached panel. The channel 68 bridges the space between the guide/support rails 54, 56 to thereby limit rotation of the yoke 136 in the clockwise direction. This pivoting movement of the yoke effects a rearward shifting of the pins 158, 160 and the carried panel. The panel in the FIG. 7 position, under its own weight, assumes a vertical orientation wherein the bottom edge thereof is displaced behind the rearwardmost panel hanging from the guide/support rails 54, 56. Downward movement of the arm 86 from the FIG. 8 position deposits the carried panel so that the channel 68 thereon is guided down and hung on the guide/support rails 54, 56. Once the forwardmost panel is elevated, the remainder of the panels shift forwardly towards the front wall 44 thereby leaving a space for the removed panel. This operation proceeds so that the panels 14–26 are serially repositioned.

It can be seen that the display surfaces 28–40 on each panel 14–26 can be supplied with their own message. The number of separate panels is limited only by the geometry of the particular cabinet 10. Further, because the panels 14–26 are compactly stored, as shown in FIG. 4, the cabinet can be made relatively small while still retaining the ability to accommodate a large number of panels.

A modified form of the inventive display device is depicted in FIGS. 12–16. The modified display device, as in the prior embodiment, has a cabinet at 310 and an interchanging/repositioning mechanism at 312 within the cabinet 310 for repositioning individual display panels 314, 316. The panels 314, 316 have display surfaces, 318, 320 respectively, which are selectively exposed for viewing at an opening 322 in the front wall 324 of the cabinet 310.

Overall, the basic operation of the modified display device in FIGS. 12–16 is the same as for the device shown in FIGS. 1–11. That is, the exposed panel 314 is raised by the mechanism 312 above the stacked panels 316 therebehind and deposited behind the rearwardmost panel 316, thereby exposing the next panel to view 316. While only two similar display panels 314, 316 are shown, the invention contemplates the use of more such panels .

The cabinet 310 consists of spaced side walls 326, 328 and inclined top and bottom walls, 330, 332, respectively, converging from front to rear on the cabinet 310. An opening 333 is maintained between the rear edges of the top and bottom walls 330, 332, to permit passage therethrough of part of the mechanism 312, as described more fully below. The side, top and bottom walls 326, 328, 330, 332 are made preferably from wood or other rigid material.

Laterally spaced, upright angles 334, 336 connect the forward portions of the top and bottom walls 330, 332 and reinforce the cabinet 310 as well as provide a mounting frame for a cover layer 338 disposed over the front portion of the cabinet 310. The cover layer 338 is made from a deformable material, such as cardboard, which defines the flat front wall 324 and the side walls 340, 342 and top wall 344, which are folded out of the plane of the front wall 324. The cover layer 338 is preferably removably secured to the remainder of the cabinet 310 as by brads or a VELCRO-type fastener. By removing the cover layer 338, the internal space 346 within the cabinet 310 is exposed to permit set-up and change of displays and/or repair of the interchange/-repositioning mechanism 312.

The mechanism 312 consists of a two-part, generally T-shaped arm 348. The stem of the T is defined by a forwardly opening U-shaped bracket 350 with outturned ends 352, 354 secured as by rivets to a U-shaped cross bar 356.

The arm 348 is mounted adjacent its rear end for pivoting movement about a horizontal, laterally extending axis on a shaft 358. The shaft 358 extends through the legs 360, 362 of the bracket 350 and the cabinet side walls 326, 328. The arm 348 is free to pivot about the shaft 358 through a prescribed range between the sloped top wall 330 and bottom wall 332 of the cabinet 310.

The forward portion of the arm 348 pivotally carries a pickup yoke 364 having a U-shaped body 366 and integral pickup arms 368 project upwardly at right angles to the plane of the U. The forward free ends of the laterally spaced legs 370, 372 on the cross bar 356 are pivotally connected to the yoke 364 at the points of juncture between the pickup arms 368 and legs 374, 376 on the yoke 364 so that the yoke 364 and arm 348 are relatively rotatable about a horizontally extending axis. The weight of the base 378 on the yoke 364 urges the yoke 364 pivotally normally in a clockwise direction in FIG. 15 about the rotational axis 380 about which the yoke 364 pivots.

In operation, a drive mechanism at 382 causes the arm 348 to pivot reciprocatively about the shaft 358 to continuously effect the interchange of display panels 314, 316, as in the previously described embodiment. A motor 384, through a speed reduction mechanism 386, drives a crank arm 388 about a horizontal, laterally extending axis 390. The arm end 392 remote from the arm end 394 connected to the motor 384, is pivotally connected to a drive link 396 for the arm 348 by a pin 398. The drive link 396 has a free end 400 to which a horizontal and laterally extending link shaft 402 is connected. The link 396 aligns laterally midway between the legs 360, 362 on the bracket 350. The ends of shaft 402 extend through the legs 360, 362 so that the bracket 350 can rotate freely about the shaft 402. As in the prior embodiment, the described linkage causes the arm 348 to pivot reciprocatively about the shaft 358 as the motor 384 is operated.

In place of the V-shaped deflector 124 in the prior embodiment, a flat sheet of rigid material, preferably plastic, defines a cam 403 with an edge 404 that engages and repositions the yoke 364 during operation. The cam 403 has a V-shaped notch 406 with sloped edge portions 408, 410 converging at a curved seat 412 in which the base 378 of the yoke 364 temporarily nests during operation.

Figures 15, 16:
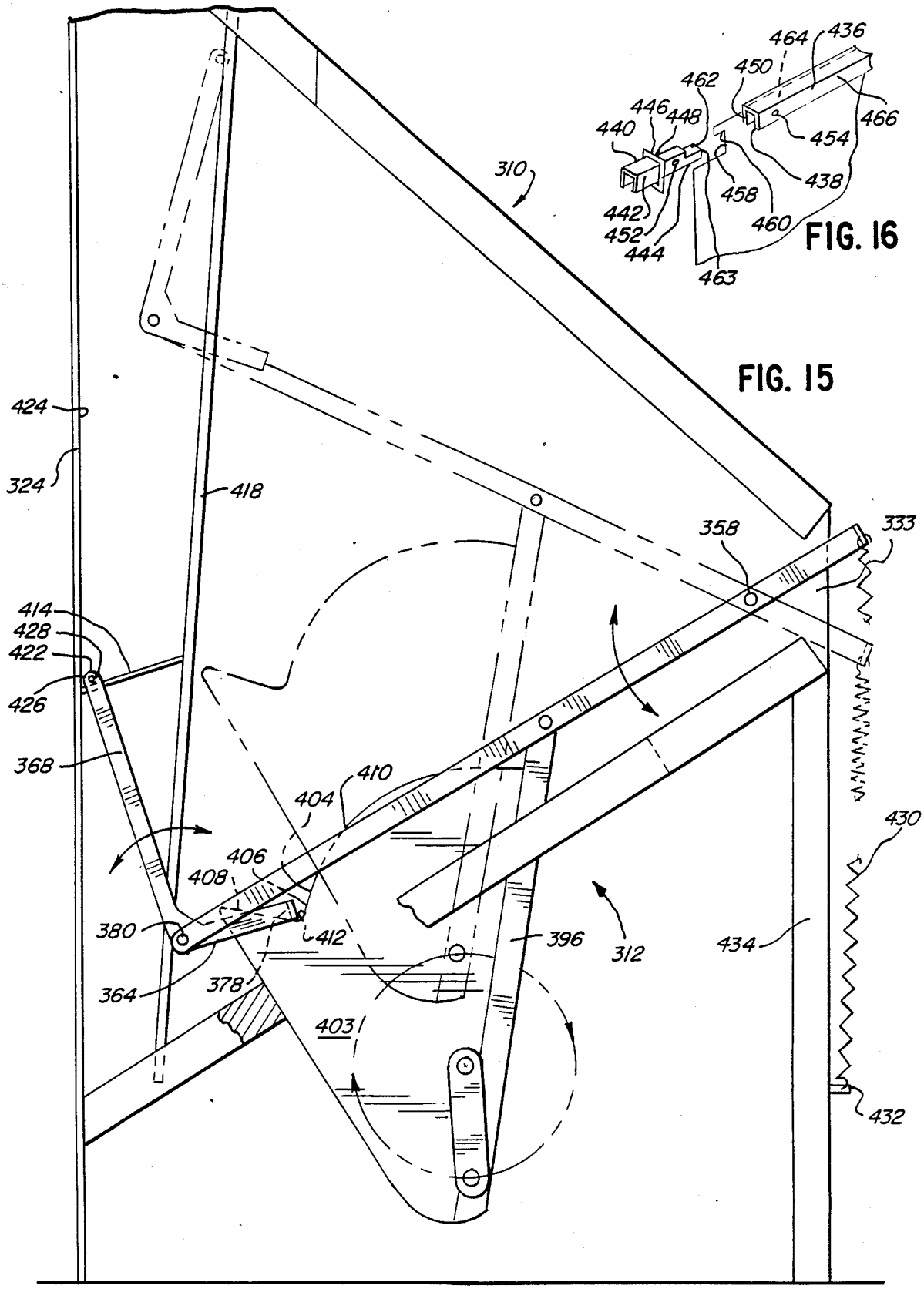
FIG. 15 an enlarged, side elevation view of the display device in FIGS. 12 and 13 and showing the repositioning mechanism in two different positions.
FIG. 16 is a fragmentary, perspective view of a hanger for individual display panels.

The panels 314, 316 hang from laterally spaced rails 414, 416, as in the prior embodiment. The rails 414, 416 support the free ends of the channels 68, as previously described. Alternatively, a hanger arrangement, such as shown in FIG. 16 and described in detail below, can be used. The opposite ends of the panel support rails 414, 416 are fixedly supported by the front wall 324 and upright, laterally spaced guide rails 418, 420. The guide rails 418, 420 are spaced sufficiently to permit the entire width of the panels 314, 316 to pass therebetween but to simultaneously intercept the free ends of the channels 68. Thus, as seen in FIG. 15, the free ends 422 of the pickup arms 368, with a panel 314, 316 carried thereby, are confined between the rearwardly facing surface 424 of the front wall 324 and the guide rails 418, 420.

In operation, as the arm 348 is moved in a clockwise direction towards the solid line position in FIG. 15, the edge portion 408 on cam 403 engages the base 378 of the yoke 364. As the cam 403 rises, the base 378 slides progressively down the edge portion 408 toward the cam seat 412 and is progressively urged by the rising cam 403 in a counterclockwise position about the axis 380 until the noses 426 of the pickup arms 368 abut the rearwardly facing surface 424 on the front wall 324. This aligns pickup pins 428 on the arms 368 directly beneath the free ends of the channels 68. Further operation of the device causes the pins 428 to draw against the channel 68 and thereby raise the forwardmost panel 314 upwardly above the remainder of the panels 316 which are stacked on the rails 414, 416.

As in the prior embodiment, at a predetermined position between the FIG. 15 solid line and phantom positions for the mechanism 312, the yoke 364 separates from the cam edge 404. As this occurs, the yoke 364 pivots in a counterclockwise direction about axis 380 under the weight of the base 378 and the carried display panel 314, 316 until the channel 68 supported by the pickup pins 428 bridges the rails 418, 420, to arrest further yoke pivoting. Continued operation of the device causes the channel 68 that is being transported to slide down the rails 418, 420 until channel 68 encounters and is borne by the supporting rails 414, 416, whereupon the pickup pins 428 unseat from the channel 68. The moving cam edge 404 will once again encounter the yoke 364 to pivot the yoke 364 into position to pick up the next panel to be moved away from the viewing opening 322.

A coil spring 430 has its ends connected to the rear of the arm 348 projecting through the cabinet space 333 and a fixed post 432 on the exterior of a rear wall 434 of the cabinet 310. The spring 430 substitutes for the counterweight 134 described in the prior embodiment and serves the same purpose.

FIG. 16 discloses an alternative construction for the channel 68, previously described. An inverted U-shaped channel 436, of a length less than the lateral dimension of the panels 314, 316, is provided and has laterally opening ends 438 (one shown). A molded plastic insert 440 has an inverted U-shaped end 442 to seat the pickup pins 428 and an opposite end 444 to be closely, slidably received in each of the open channel ends 438. A raised bead 446 on each insert 440 defines a shoulder 448 to abut the free edge 450 of the channel 436 with the insert 440 fully extended into the channel 436. With the shoulder 448 abutting the edge 450, a post 452 aligns with and extends into a through opening 454 in the channel 436 to fix the insert 440 and channel 436 together.

Each display panel 456 has an L-shaped cut-out 458 defining a downwardly facing edge 460 to bear on an upwardly facing shoulder 462 defined by a cut-out in the one end 444 of the insert 440.

With the described arrangement, the panel 456 is prevented from shifting laterally by facing surfaces 463 at the free ends of the inserts 440. The panel 456 is supported on the inserts 440 by the cooperation of the edges 460 thereon and the edges 462 on the inserts 440. The panel is normally frictionally grasped between the legs 464, 466 of the channel 436. Each panel is resultingly positively held to the inserts 440 and channel 436 and positively centered between the rails 418, 420 in the cabinet 310.

It should be understood that the foregoing detailed description is made for purposes of demonstrating a preferred form of the invention and its operation, with no unnecessary limitations to be understood therefrom.

I claim:

1. A display device comprising:

a first panel having a first display surface;

a second panel having a second display surface;

a cabinet having a viewing opening at the front thereof;

means for mounting the first and second panels in a first overlying relationship wherein the display surface on one of the first and second panels is exposed to view at the front of the cabinet and the one of the first and second panels blocks viewing of the display surface on the other of the first and second panels from the front side of the cabinet;

means for repositioning the first and second panels in a second overlying relationship wherein the display surface on the other of the first and second panels is exposed to view at the front of the cabinet and the other of the first and second panels blocks viewing of the display surface on the one of the first and second panels from the one side of the cabinet, said repositioning means including an arm, means for mounting the arm to the cabinet for reciprocating pivoting movement in first and second opposite directions in a predetermined path, drive means for moving said arm in said predetermined path, a yoke having means thereon for individually engaging and lifting said panels, and means for pivotably connecting the yoke to the arm for pivoting of the yoke relative to the arm about a single axis; and cooperating means on the repositioning means and cabinet for causing the lifting means to (a) engage the one of the first and second display panels that has its display surface exposed to view through the viewing opening, (b) lift the one display panel above the other display panel as said arm moves in a first portion of said predetermined path, (c) shift the one display panel behind the other display panel as the arm moves in another portion of said predetermined path and the yoke pivots relative to the arm and (d) release the one display panel as said arm moves in still another portion of said predetermined path so that the other display panel has its display surface exposed for viewing through the panel viewing opening, whereby each time said arm moves in said first and second opposite direction in said predetermined path, the display surface exposed to view at the front of the cabinet can be changed.

2. The display device according to claim 1 wherein each said panel comprises a flat sheet of flexible material with an edge and there is a channel which surrounds and frictionally engages each said panel edge and each said channel has a downwardly facing surface that is engaged by said lifting means as the display device is operated and said arm pivots in said first direction.

3. The display device according to claim 2 wherein said lifting means comprises at least one pin to engage the downwardly facing surface on the channel.

4. The display device according to claim 1 wherein the means mounting the first and second panels includes means for causing the panels to be urged under their own weight against each other and toward said front wall so as to be in close proximity to said viewing opening.

5. The display device according to claim 4 wherein the means for causing the panels to be urged comprises at least one rail inclined downwardly towards the front wall and means are provided on each panel for guiding movement of the panels along the rail towards said front wall.

6. The display device according to claim 1 wherein said means for connecting the yoke connects the yoke so that under the weight of the yoke there is a torque tending to normally rotate the yoke relative to the arm in a first direction, said cooperating means including means for biasing the yoke relative to the arm in a direction opposite to the first direction as the lifting means on the yoke engages one panel having its display surface exposed to view at the front of the cabinet and said arm pivots through part of said predetermined range and to release the yoke so that the yoke moves under its weight and that of a display panel which the yoke carries in said first direction to shift the one panel behind the other panel as the arm pivots through another part of said predetermined range.

7. The display device according to claim 6 wherein said biasing means engages the yoke through a portion of the predetermined range and separates from said yoke during another portion of the predetermined range.

8. The display device according to claim 6 wherein said means for biasing the yoke comprises a deflector, means are provided for connecting the deflector to the drive means to be driven by the drive means and means are provided for pivotally mounting the deflector to the arm for pivoting movement relative thereto.

9. The display device according to claim 8 wherein means are provided for connecting the deflector to the arm so that the drive means imparts reciprocating movement to the arm through said deflector.

10. The display device according to claim 6 wherein means are provided for limiting rotation of the yoke in said first direction through a portion of the pivoting range of said arm, said limiting means comprising a vertically extending rail on the cabinet which rail abuts a panel upon said panel being lifted and moved rearwardly by said lifting means on the yoke.

11. The display device according to claim 1 wherein the yoke is mounted for pivoting movement relative to the arm about a first horizontal axis, the arm pivots about a second axis that is substantially parallel to the first axis and the first axis is situated at all times forwardly of the second axis.

* * * * *